US005309598A

United States Patent [19]

Carpenter

[11] Patent Number: 5,309,598

[45] Date of Patent: May 10, 1994

[54] PAINT SCRAPER KIT

[76] Inventor: Joyce A. Carpenter, P.O. Box 124, Oxford Junction, Iowa 52323-0124

[21] Appl. No.: 69,743

[22] Filed: Jun. 1, 1993

[51] Int. Cl.[5] ..... A47L 13/02

[52] U.S. Cl. ..... 15/236.08; 15/236.01; 15/236.05; 15/236.09; 30/169

[58] Field of Search ..... 15/145, 176.4, 235.7, 15/236.01, 236.05, 236.06, 236.08, 236.09; 30/169, 172

[56] References Cited

U.S. PATENT DOCUMENTS

| | | | |
|---|---|---|---|
| 406,199 | 7/1889 | Cridge | 15/236.08 |
| 555,854 | 3/1996 | Davenport | 15/145 |
| 670,120 | 3/1901 | Van Tuyl | 15/236.05 |
| 800,872 | 10/1905 | Newcomb | 15/236.05 |
| 891,871 | 6/1908 | Smith | 15/236.01 |
| 925,259 | 6/1909 | Ziegler | 15/145 |
| 1,249,529 | 12/1917 | Smith | 15/236.05 |
| 1,527,561 | 2/1925 | Klum | 30/169 |
| 1,693,566 | 11/1928 | Pflueger | 30/169 |
| 2,169,414 | 8/1939 | Giddings | 30/172 |
| 2,319,048 | 5/1943 | Fell | 15/236.01 |
| 2,505,586 | 4/1950 | Singer | 15/236.06 |
| 2,599,193 | 6/1952 | Morris | 30/169 |
| 3,079,622 | 3/1963 | Smyers | 15/235.7 |
| 3,363,316 | 1/1968 | Skarsten | 15/236.05 |
| 4,757,572 | 7/1988 | Yon | 15/235.8 |
| 5,010,618 | 4/1991 | Croft | 15/235.7 |
| 5,067,889 | 11/1991 | Humiston | 15/235.7 |

FOREIGN PATENT DOCUMENTS

| | | | |
|---|---|---|---|
| 3004708 | 8/1980 | Fed. Rep. of Germany | 15/176.4 |
| 3001495 | 7/1981 | Fed. Rep. of Germany | 15/145 |
| 2226532 | 11/1974 | France | 15/235.7 |
| 633781 | 2/1962 | Italy | 30/169 |
| 3944 | of 1879 | United Kingdom | 30/169 |
| 0907863 | 10/1962 | United Kingdom | 15/236.05 |
| 0924175 | 4/1963 | United Kingdom | 15/236.05 |

*Primary Examiner*—Philip R. Coe
*Assistant Examiner*—Randall E. Chin
*Attorney, Agent, or Firm*—Leon Gilden

[57] ABSTRACT

A plurality of handles are arranged for selective mounting one of a plurality of blade members, wherein the blade members include blade members of triangular, square, and intersecting plate-like configurations to accommodate various scraping surfaces.

1 Claim, 4 Drawing Sheets

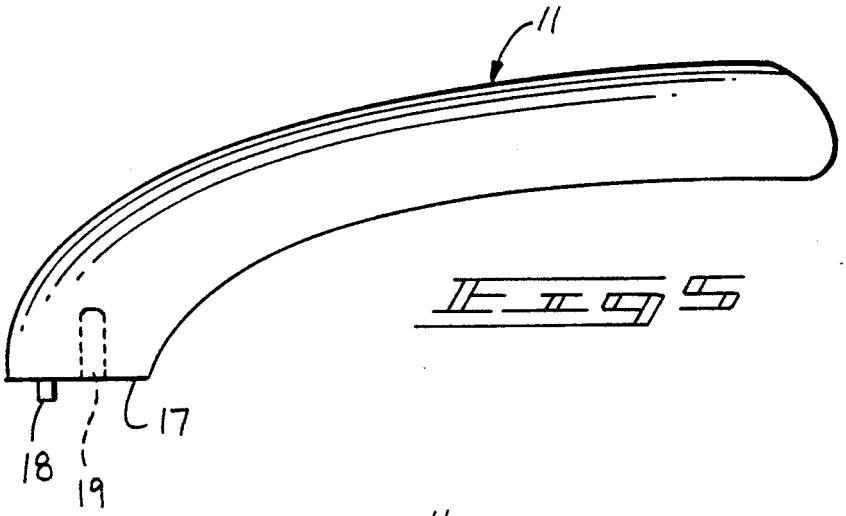
Fig 5
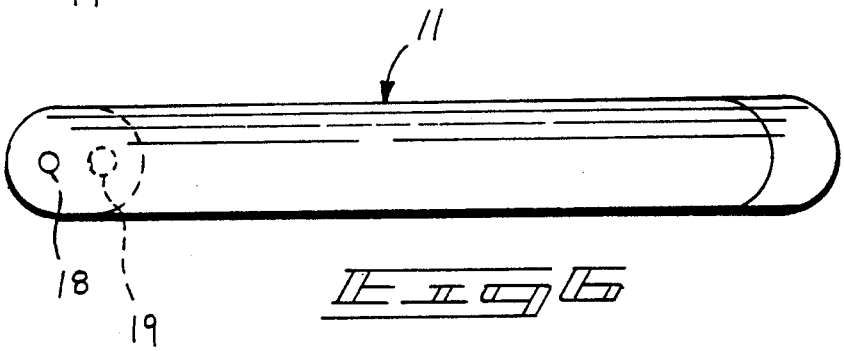
Fig 6
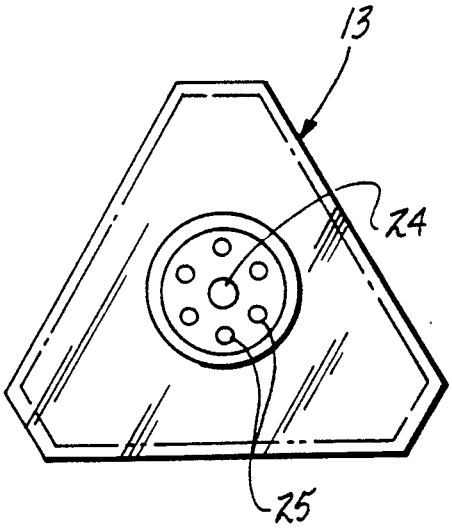
Fig 7
Fig 8
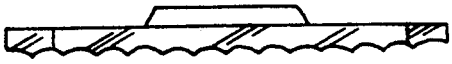

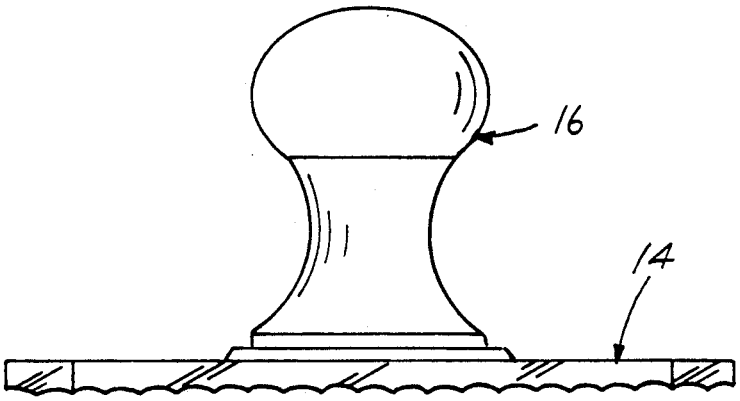
Fig 9
Fig 10
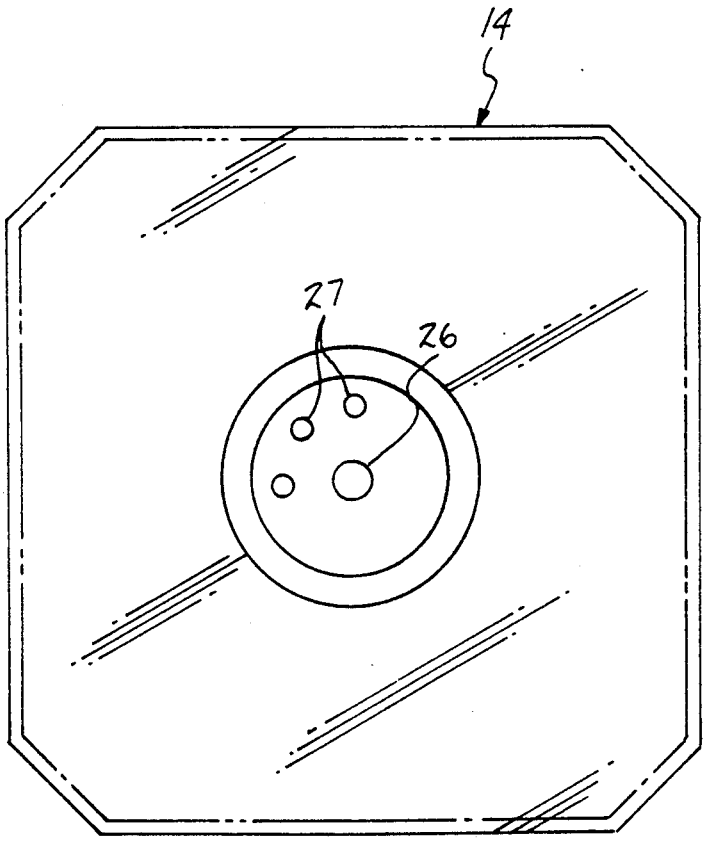

PAINT SCRAPER KIT

BACKGROUND OF THE INVENTION

1. Field of the Invention

The field of invention relates to scraping tools, and more particularly pertains to a new and improved paint scraper kit wherein the same is arranged to accommodate selective mounting of various blades to a handle structure.

2. Description of the Prior Art

Paint scrapers of various types have been utilized throughout the prior art and exemplified by the U.S. Pat. Nos. 4,200,948 and 4,984,324.

The instant invention attempts to overcome deficiencies of the prior art by providing for a plurality of blades arranged for selective mounting to a handle member and in this respect, the present invention substantially fulfills this need.

SUMMARY OF THE INVENTION

In view of the foregoing disadvantages inherent in the known types of paint scraper apparatus now present in the prior art, the present invention provides a paint scraper kit including triangular blades, a square blade, and intersecting blade structure to accommodate the scraping of various surfaces prior to a painting procedure. As such, the general purpose of the present invention, which will be described subsequently in greater detail, is to provide a new and improved paint scraper kit which has all the advantages of the prior art paint scraper apparatus and none of the disadvantages.

To attain this, the present invention provides a plurality of handles arranged for selective mounting one of a plurality of blade members, wherein the blade members include blade members of triangular, square, and intersecting plate-like configurations to accommodate various scraping surfaces.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved paint scraper kit which has all the advantages of the prior art paint scraper apparatus and none of the disadvantages.

It is another object of the present invention to provide a new and improved paint scraper kit which may be easily and efficiently manufactured and marketed.

It is a further object of the present invention to provide a new and improved paint scraper kit which is of a durable and reliable construction.

An even further object of the present invention is to provide a new and improved paint scraper kit which is susceptible of a low cost of manufacture with regard to both materials and labor, and which accordingly is then susceptible of low prices of sale to the consuming public, thereby making such paint scraper kits economically available to the buying public.

Still yet another object of the present invention is to provide a new and improved paint scraper kit which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic side view of the handle.

FIG. 6 is an orthographic top view of the handle.

FIG. 7 is an orthographic top view of the second blade member.

FIG. 8 is an orthographic end view of the second blade member.

FIG. 9 is an orthographic view taken in elevation of a third blade having a further handle member mounted thereto.

FIG. 10 is an orthographic top view of the third blade.

DESCRIPTION OF THE PREFERRED EMBODIMENT

Figure 1:
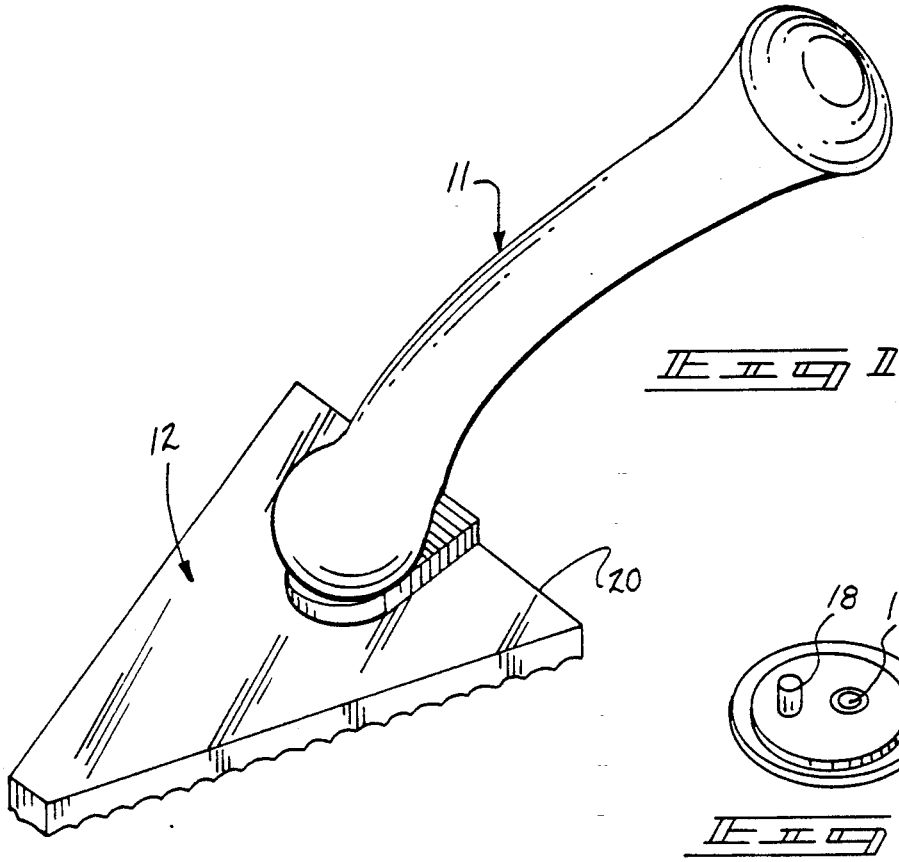
FIG. 1 is an isometric illustration of the handle mounted to a first blade member.
Figure 2:
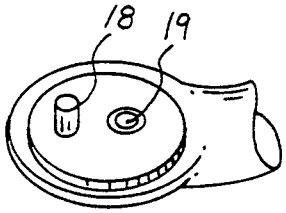
FIG. 2 is an isometric illustration of the handle mounting surface.
Figure 3:
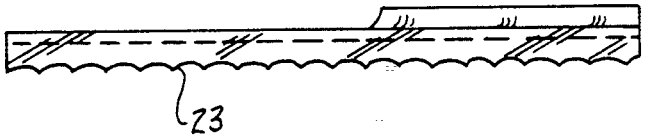
FIG. 3 is an orthographic side view of the first blade.
Figure 4:
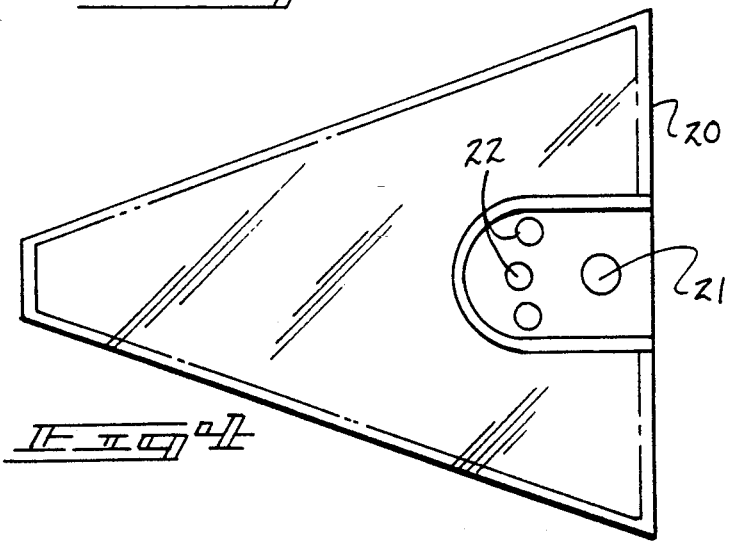
FIG. 4 is an orthographic top view of the first blade.

With reference now to the drawings, and in particular to FIGS. 1 to 12 thereof, a new and improved paint scraper kit embodying the principles and concepts of the present invention and generally designated by the reference numerals 11–31 will be described.

Figure 11:
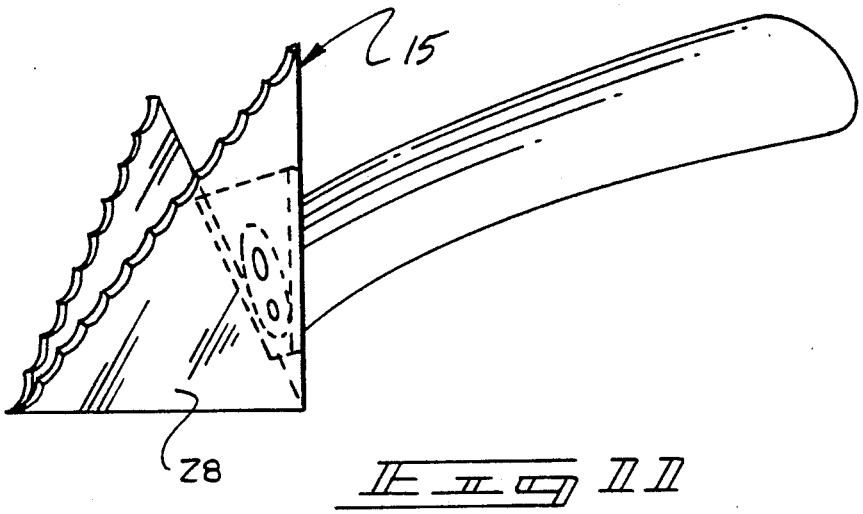
FIG. 11 is an isometric illustration of the handle mounted to a fourth blade member.
Figure 12:
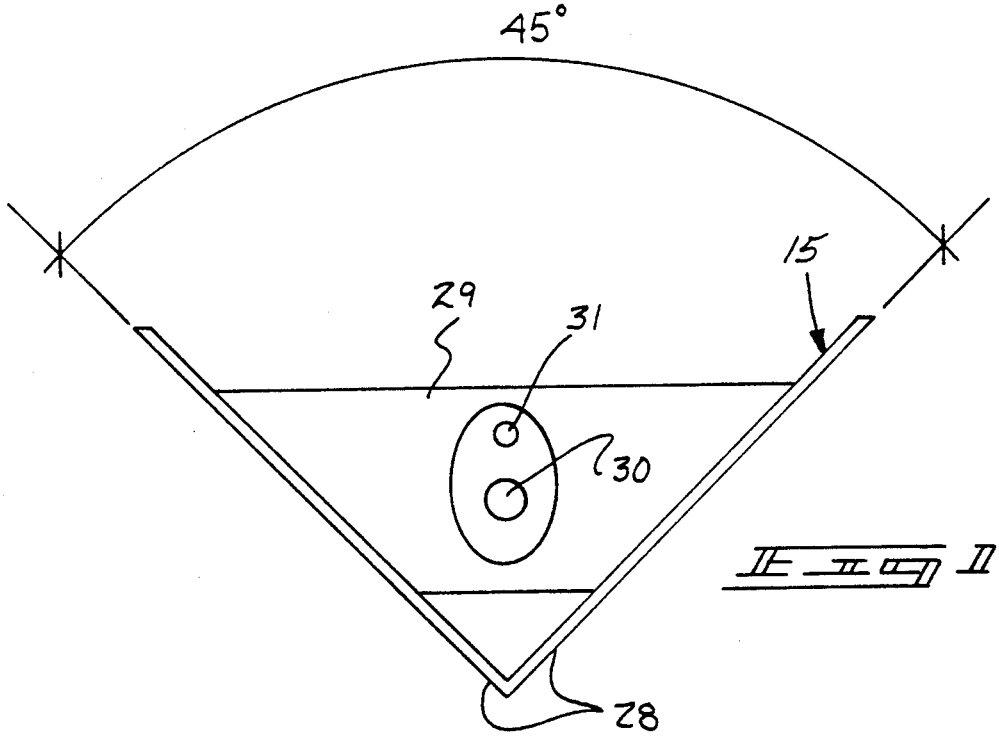
FIG. 12 is an orthographic top view of the fourth blade member.

More specifically, the paint scraper kit of the instant invention essentially comprises an arcuate handle 11, as indicated in FIG. 11 for example, cooperatively mounted to a first blade plate member 12 or selectively to a second blade plate member 13 (see FIG. 7), a third blade plate member 14 (see FIG. 10), or to a fourth blade assembly 15, as indicated in FIG. 11. The handle 11 includes a planar end wall 17, with and end wall lug 18 projecting orthogonally from the end wall, with the end wall lug 18 spaced from an end wall internally threaded bore 19, with the lug 18 and the bore 19 arranged in a parallel spaced relationship defined by a predetermined spacing. The first blade plate 12 includes a first blade end wall 20, wherein spaced in adjacency and medially thereof is a first fastener bore 21 arranged to receive a first fastener therethrough for reception within the end wall threaded bore 19. An arcuate array of alignment bores 22 of said first blade are arranged concentrically about the first blade fastener bore 21 for one of said alignment bores 22 to receive selectively the end wall lug 18 permitting angulation of the handle 11 relative to the first blade plate member top wall. The first blade plate member bottom wall 23 includes a scraping matrix of projections to effect the scraping of paint and the like. The alignment bores 22 are spaced from said first fastener bore 21 by said predetermined spacing.

The second blade plate 13, as indicated in FIGS. 7 and 8, is of a generally equilateral triangular configuration, having truncated ends, as indicated in FIG. 7, with a second blade fastener bore 24 oriented orthogonally and medially of the second blade plate, with a circular array of alignment bores 25 spaced a predetermined spacing from said second blade fastener bore to permit desired orientation in a circular array of the handle 11. The third blade plate member 14, as indicated in FIGS. 9 and 10, includes a third blade mounting bore 26 medially thereof, with a third blade semi-annular array of alignment bores 27. As the third blade plate 14 is of a generally square configuration, the semi-annular array of alignment bores 27 defines an arc of substantially forty-five degrees an equal distance about two sides of the third blade plate member 14.

The fourth blade scraping plate 28 is arranged to accommodate scraping within corners and the like and includes fourth blade scraping plates 28 intersecting at an acute angle, preferably an angle of forty-five degrees such that a connecting web 29 extends between the fourth blade scraping plates 28, with the connecting web 29 having a fourth blade fastener bore 30 directed therethrough for alignment with the end wall threaded bore 19 to receive a fastener, with a single fourth blade alignment bore 31 directed through the web 29 such that the alignment bore 31 and the fourth blade fastener bore 30 bisect the included acute angle between the fourth blade scraping plates 28.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A paint scraper kit, comprising, an arcuate handle, the arcuate handle including a handle end wall, with the handle end wall including an end wall lug, the end wall lug projecting orthogonally and beyond the end wall, and an end wall threaded bore directed into the handle through the end wall, with the end wall lug and the threaded bore arranged in a parallel relationship relative to one another spaced apart a predetermined spacing, and a plurality of blade members selectively mounted to said handle, said plurality of blade members including a first blade plate, a second blade plate, third blade plate, and a fourth blade plate wherein the first blade plate is of a generally isosceles triangular configuration, and the second blade plate is of a generally equilateral triangular configuration, with the first blade plate having a first blade end wall and a first blade fastener bore directed orthogonally through the first blade in adjacency to the first blade end wall medially of the first blade end wall, and an arcuate array of alignment bores concentrically oriented about the first blade fastener bore, wherein the first blade fastener bore is arranged for coaxial alignment with the end wall threaded bore, and said one of said array of alignment bores arranged for reception of said end wall lug, wherein the second blade plate has a second blade fastener bore directed medially of a second blade plate top wall, with a circular array of second blade alignment bores directed through the second blade concentrically relative to the second blade fastener bore, and wherein the third blade plate is of a generally square configuration, having a third blade fastener bore directed orthogonally and medially of said third blade, with a semi-annular array of third blade alignment bores concentrically oriented relative to said third blade fastener bore oriented about said third blade fastener bore, and said fourth blade plate includes a plurality of fourth blade scraping plates intersecting one another at an acute included angle therebetween, with a connecting web directed between the fourth blade scraping plates, the connecting web including a fourth blade fastener bore oriented medially of the connecting web, and a fourth blade alignment bore, wherein the fourth blade fastener bore and the fourth blade alignment bore are arranged colinear relative to one another and bisecting a predetermined acute angle between said fourth blade scraping plates.

* * * * *